US007677171B2

(12) United States Patent
Schaede

(10) Patent No.: US 7,677,171 B2
(45) Date of Patent: Mar. 16, 2010

(54) PRINTING MACHINE AND PROCESS FOR PRINTING INCLUDING A CHAIN GRIPPER SYSTEM

(75) Inventor: Johannes Georg Schaede, Würzburg (DE)

(73) Assignee: KBA-Giori S.A., Lausanne (CH)

( * ) Notice: Subject to any disclaimer, the term of this patent is extended or adjusted under 35 U.S.C. 154(b) by 710 days.

(21) Appl. No.: 10/591,139

(22) PCT Filed: Mar. 23, 2005

(86) PCT No.: PCT/IB2005/000787

§ 371 (c)(1),
(2), (4) Date: Aug. 30, 2006

(87) PCT Pub. No.: WO2005/095109

PCT Pub. Date: Oct. 13, 2005

(65) Prior Publication Data

US 2007/0193462 A1 Aug. 23, 2007

(30) Foreign Application Priority Data

Mar. 30, 2004 (EP) ..... 04007631

(51) Int. Cl.
*B41F 21/08* (2006.01)

(52) U.S. Cl. ..... 101/232; 101/116; 101/118

(58) Field of Classification Search ..... 101/114, 101/116, 118, 232
See application file for complete search history.

(56) References Cited

U.S. PATENT DOCUMENTS

| | | | | |
|---|---|---|---|---|
| 3,664,261 | A * | 5/1972 | Dahlgren | 101/177 |
| 4,574,696 | A | 3/1986 | Giori | |
| 4,640,189 | A | 2/1987 | Hernandez | |
| 5,477,780 | A | 12/1995 | Keller | |
| 6,109,172 | A | 8/2000 | Wyssmann | |
| 2002/0063382 | A1 | 5/2002 | Frank et al. | |

FOREIGN PATENT DOCUMENTS

| | | | |
|---|---|---|---|
| DE | 197 03 312 | A1 | 8/1998 |
| GB | 2 277 903 | A | 11/1994 |
| GB | 2 314 834 | A | 1/1998 |
| WO | WO 98/53996 | A1 | 12/1998 |

* cited by examiner

*Primary Examiner*—Leslie J Evanisko
(74) *Attorney, Agent, or Firm*—Crompton, Seager & Tufte, LLC

(57) ABSTRACT

The machine comprises at least a printing cylinder (4), an inking cylinder (5) and a chain gripper transporting system (2,3) with grippers (17). The printing cylinder (4) comprises at least one transversal pit (7) for receiving said chain gripper system (3) such that the inking cylinder (5) inks the planar object (1) while said object (1) is held by said chain gripper system (3).

14 Claims, 3 Drawing Sheets

PRINTING MACHINE AND PROCESS FOR PRINTING INCLUDING A CHAIN GRIPPER SYSTEM

FIELD

Figure 1:
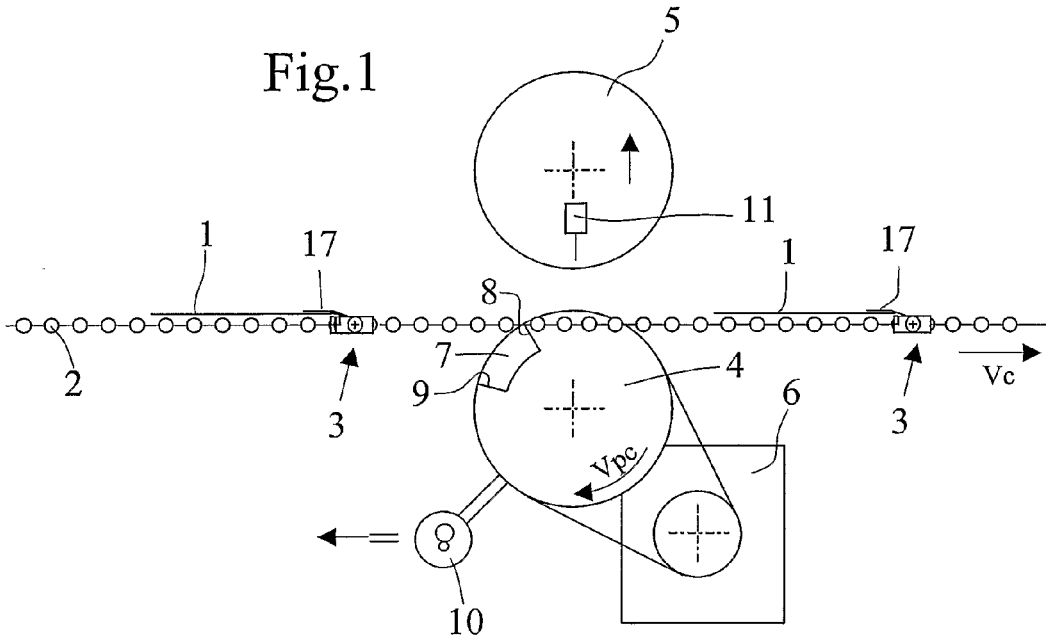

The present invention concerns a printing process for sheets of documents, such as securities, banknotes, checks, ID and passports.

BACKGROUND

The present invention also concerns a printing machine suitable for carrying out the process according to the invention.

Printing processes and machines are known per se in the prior art. For example, U.S. Pat. No. 4,574,696, the content of which is incorporated by reference in the present application, discloses a rotary printing press for the simultaneous multicolour printing on both sides of a web or sheet. The advantage of this machine consists in that it permits exploiting simultaneously two totally different methods for printing in a single pass an offset image on one side and an "Orlof" image on the other side, thus offering the user for the first time the possibility of printing notably safety backgrounds on both sides of a bank note through two different methods; this increases the safety against forgery and in addition makes printing operations more economical because the user is not compelled to use two separate machines.

Another printing machine is known for example from U.S. Pat. No. 4,640,189, the content of which is incorporated by reference in the present application. This printing machine can print on both sides of a paper web either an image with juxtaposed colors by means of a typographic plate inked respectively by a collecting cylinder inked in turn by selective inking cylinders the number of which corresponds to the number of colors, or an image with superposed colors and designs by means of the plate cylinders substituted for the selective color inking cylinders and provided with printing plates inking a corresponding offset cylinder and of which the number corresponds to the number of colors and designs, or an image of each of the above-mentioned type. For this purpose, the machine comprises a first pair of blanket cylinders operating either as collecting cylinders each adapted to ink a cylinder carrying said typographic plate of which the image is transferred via an intermediate cylinder to another blanket cylinder of a second pair on the paper, or as offset cylinders contacting said other blanket cylinder, or operating one as collecting cylinder and the other as an offset cylinder. In all cases, the paper passes between the blanket cylinders of the second pair.

Another printing technique so called silk-screen printing is also known in the art. For example, U.S. Pat. No. 6,109,172, the content of which is incorporated by reference in the present application, discloses a silk-screen printing machine with a printing cylinder engaging two stencil cylinders for printing at least two non-overlapping areas in different colors using the one printing cylinder.

Document DE 197 03 312 discloses a printing machine in which the sheets are held by a chain gripper system while being printed. However, in this document, the speed of rotation of the printing cylinder is maintained constant.

SUMMARY

The idea of the present invention is to propose a printing system that needs less space to be implemented and also that is more efficient and quicker than the known printing systems.

It is therefore an aim of the present invention to improve the known processes and machines.

It is another aim of the present invention to provide a printing machine that can be built as a modular unit.

It is a further aim of the present invention to provide a printing process and machine that are faster than the known one.

To this effect, the invention is defined by the features of the claims.

BRIEF DESCRIPTION

The invention will be best understood by the description of an exemplary embodiment and of the accompanying drawings in which FIGS. 1 to 4 show in succession the preparation steps for the printing of a sheet while carried by a chain conveyor according to the present invention.

Figure 5:
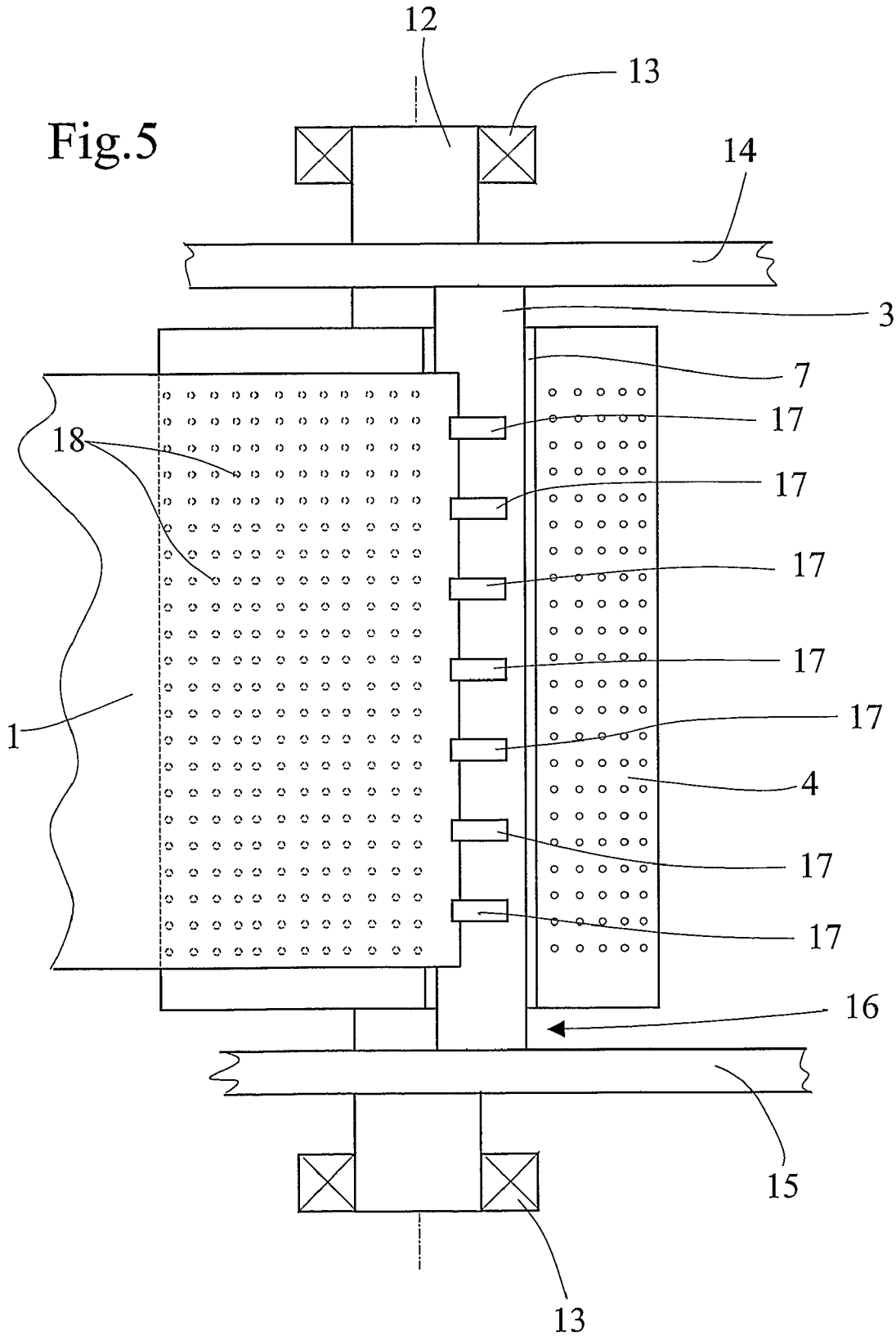

FIG. 5 show a top view of a printing cylinder according to the present invention.

DETAILED DESCRIPTION

As shown in FIG. 1, a sheet 1 is transported by a chain conveyor 2 with a chain gripper system 3, as is well known in the art of printing machines. As schematically disclosed in this FIG. 1, the chain conveyor 2 also passes between two cylinders, a printing cylinder 4 and a screen cylinder 5, both cylinders being used for the printing operation.

The screen printing technique per se is known in the art, and reference is for example made to U.S. Pat. No. 6,109,172 for the sake of completeness. As represented, the printing cylinder is driven by an independent motor 6 which is able to vary the rotational speed $V_{pc}$ of the printing cylinder. The printing cylinder 4 comprises at least one cylinder pit 7 with a leading edge 9 and a trailing edge 8 of the printing cylinder 4, said pit being intended to receive the chain gripper system 3 of the chain conveyor 2. The printing cylinder 4 is also subjected to vacuum air to maintain the sheet on the printing cylinder 4 during the printing operation. The suction air (vacuum) is created by a vacuum system with at least an aspiration pump 10 which is connected to ducts in the printing cylinder 4 to apply the suction air to the sheet 1 being printed.

In addition, the screen cylinder 5 is moved away from the printing cylinder 4 when not in printing operation, with the doctor blade 11 being lifted to avoid damaging the screen, as represented.

Figure 2:
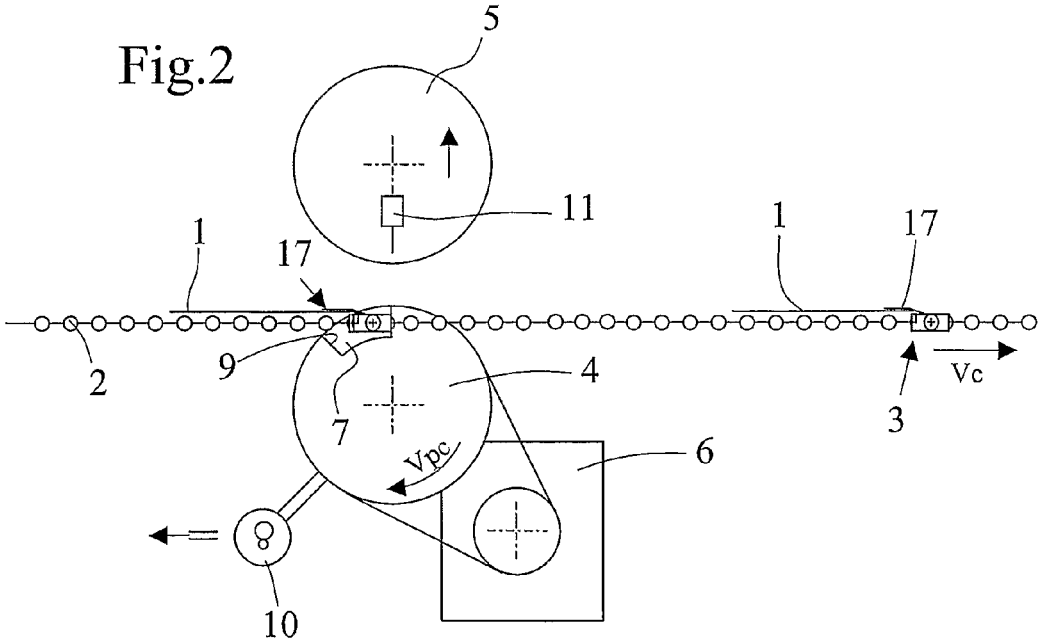

In FIG. 2, the gripper 17 of the chain gripper system 3 is entering the pit 7 of the printing cylinder 4. For avoiding a collision of the front side of the gripper 17 with trailing edge 8 of the cylinder 4, the speed of the printing cylinder $V_{pc}$ is adjusted by regulating means acting on the motor 6, known per se in the art, such that the front side of the gripper is coordinated with the trailing edge 8 of the cylinder 4. During this operation, the screen cylinder 5 and the doctor blade 11 preferably remain shifted away from the printing cylinder 4, for example lifted to avoid a collision with the chain gripper system 3.

Figure 3:
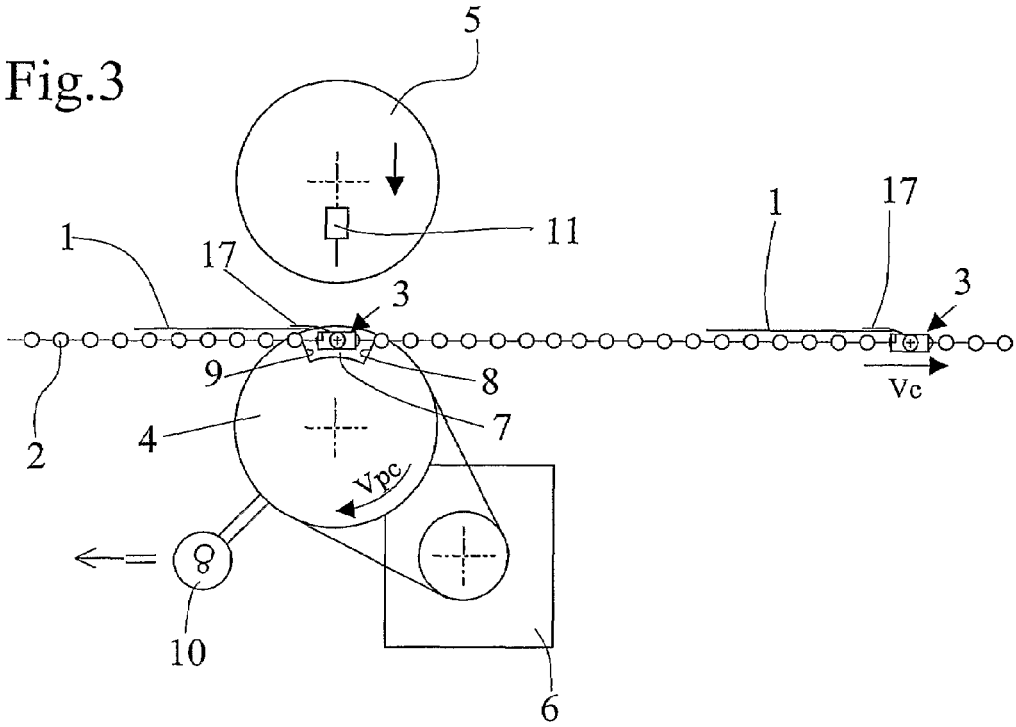

In FIG. 3, the chain gripper system 3 is now in the pit 7 of the printing cylinder 4 and the speed of the cylinder $V_{pc}$ is increased relatively to the speed of the chain gripper system $V_c$ in order for the back side of the chain gripper system 3 to attain the leading edge 9 of the cylinder 4. This is necessary to start the printing operation with a minimal white margin on the sheet 1. During the phase represented in FIG. 3, the doctor blade 11 and the screen cylinder start going into position (i.e. downwards as represented in FIG. 3) to be able to carry out the printing operation.

Figure 4:
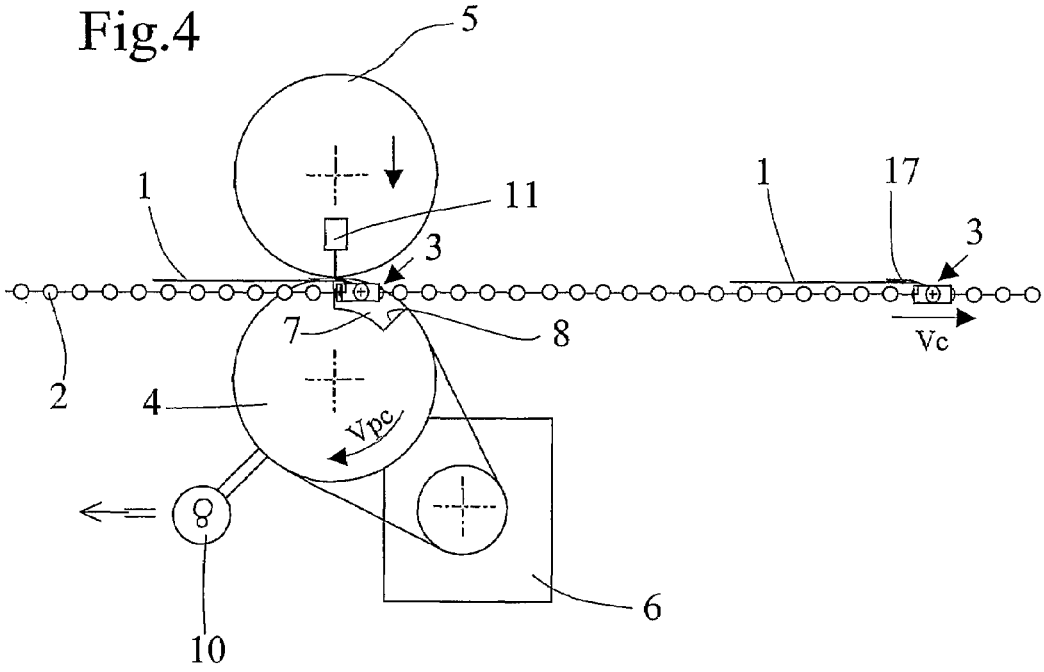

In FIG. 4, the beginning of the printing operation is shown. As represented, the screen cylinder 5 is brought into contact with the printing cylinder 4 and the doctor blade 11 is applied against the screen to carry out the printing operation per se on the sheet 1. The screen printing technique is known as such in the art of printing. During the entire printing step, the sheet is held by the chain gripper system 3 of the chain conveyor 2, and the sheet is further maintained against the printing cylinder 4 at the printing nip between cylinders 4 and 5 by the application of vacuum air through the surface of the printing cylinder 4. This technique is also known per se in the art. Preferably, the printing speed, that is the speed of rotation of both cylinders 4, 5 is slightly higher than the speed of the chain conveyor 2 to avoid production of misprints due to a speed difference between the chain gripper system 2 and the cylinders 4, 5 and maintain the proper relative position of gripper 17 and pit 7.

In order to carry out the displacement movements of screen cylinder 5 and blade 11, it is possible to use numerous means such as excentrical systems, or pneumatically activated means, all well known in the art.

The printing cylinder may also comprise more than one pit, for example two or three pits which would then correspond to successive chain grippers systems 3 on the chain conveyor 2. The principle indicated above would then be applicable to such configurations for each successive sheet.

A printing cylinder according the present invention is represented in top view in FIG. 5. The cylinder 4 comprises a pit 7 along its entire transversal length and is supported by an axis 12 held by bearings 13. The chain conveyor 2 comprises two parallel running chains 14, 15, running perpendicularly to the axis 12, said chains supporting the gripper system 16 per se and being situated on both sides of the cylinder 4. The chain gripper system 3 comprises several grippers 17 mounted on a chain gripper system 3 attached to the chains 14, 15 and said grippers 17 hold the sheet 1 to be printed. As such, the chain gripper system 3 is known in the art of sheet transporting devices for printing machines.

The printing cylinder 4, as mentioned above, is linked to a vacuum system, schematically represented in FIG. 1 by pump 10 linked to series of holes 18 (see FIG. 5) to maintain the sheet 1 pressed against the cylinder 4 during the printing operation and allowing the cylinder 4 to drive the sheet 1 being printed at the cylinder speed $V_{pc}$.

This vacuum system is synchronized such that vacuum is applied to the sheet being printed only in the zone in which the printing is carried out. Accordingly, each row of holes parallel to the axis of the cylinder is subjected to vacuum in turn, depending on the position of the cylinder 4.

The process according to the present invention is particularly advantageous to carry out a recto-verso silk-screen printing.

Depending on the configuration of the machine, it can be useful to add a drying unit to dry the printed sheets. The drying unit maybe an UV drying unit or other equivalent. Such a drying unit is particularly useful when carrying out a recto-verso printing of the sheets.

The invention claimed is:

1. A process for printing successive sheets of documents, such as securities, banknotes, checks, ID and passports, the process comprising the steps of:

transporting the successive sheets by a chain gripper system including successive grippers attached to two parallel chains, providing a printing unit including a printing cylinder with at least one transversal cylinder pit, wherein the successive sheets are printed in said printing unit while being held by the chain gripper system, and wherein the chain gripper system has a chain speed $V_c$ and the printing cylinder has a printing cylinder speed $V_{pc}$, wherein the chain speed $V_c$ and the printing cylinder speed $V_{pc}$ are synchronized such that a gripper of the chain gripper system enters said cylinder pit at a trailing edge of said printing cylinder, wherein said chain speed $V_c$ and said printing cylinder speed $V_{pc}$ are then relatively modified such that said gripper arrives at a leading end of said printing cylinder when ink starts to be deposited on the sheet being printed.

2. A process as claimed in claim 1, wherein the printing unit comprises the printing cylinder and a screen cylinder cooperating with said printing cylinder.

3. A process as claimed in claim 2, wherein said relative modification of speed comprises an increase of the printing cylinder speed $V_{pc}$.

4. A process as claimed in claim 2, wherein the screen cylinder is shifted away from the printing cylinder to allow the cylinder pit to receive the gripper and the screen cylinder is shifted towards the printing cylinder to allow the printing operation.

5. A process as claimed in claim 2, wherein the speed of the printing cylinder and of the screen cylinder is slightly higher than the chain speed $V_c$ during the printing operation.

6. A process as claimed in claim 5, wherein the screen cylinder is shifted away from the printing cylinder to allow the cylinder pit to receive the gripper and the screen cylinder is shifted towards the printing cylinder to allow the printing operation.

7. A process as claimed in claim 6, wherein during the printing operation, the sheet is maintained against the printing cylinder by vacuum.

8. A process as claimed in claim 1, wherein during the printing operation, the sheet is maintained against the printing cylinder by vacuum.

9. A printing machine for printing successive sheets of documents, such as securities, banknotes, checks, ID and passports and other similar documents, comprising:

a printing unit with at least a printing cylinder; and a chain gripper system with successive grippers for transporting the successive sheets, wherein the printing cylinder comprises at least one transversal cylinder pit for receiving the grippers of said chain gripper system such that the successive sheets are printed in the printing unit while being held by said chain gripper system, wherein said printing cylinder is driven by an independent motor, wherein said printing machine further comprises regulating means acting on said independent motor in order to vary the relative speed between the printing cylinder and the chain gripper system, wherein a chain speed $V_c$ of the chain gripper system and a printing cylinder speed $V_{pc}$ of the printing cylinder are synchronized such that a gripper of the chain gripper system enters said cylinder pit at a trailing edge of said printing cylinder, and wherein said chain speed $V_c$ and said printing cylinder speed $V_{pc}$ are then relatively modified such that said gripper arrives at a leading end of said printing cylinder when ink starts to be deposited on the sheet being printed.

10. A machine according to claim 9, wherein the printing unit comprises the printing cylinder and a screen cylinder cooperating with said printing cylinder and wherein said screen cylinder is shiftable towards and away from the printing cylinder by shifting means to allow the chain gripper system to enter in said transversal pit before printing.

11. A machine according to claim 10, further comprising an aspiration system for applying vacuum to the printing cylinder.

12. A machine according to claim 9, further comprising an aspiration system for applying vacuum to the printing cylinder.

13. A machine according to claim 12, further comprising at least one drying unit.

14. A machine according to claim 9, further comprising at least one drying unit.

* * * * *